United States Patent [19]

Menard et al.

[11] 4,352,345

[45] Oct. 5, 1982

[54] SHAFT POSITION SENSOR FOR INTERNAL COMBUSTION ENGINE EQUIPPED WITH AN ELECTRONIC IGNITION SYSTEM

[75] Inventors: Christian Menard; Philippe Gaches, both of Paris, France

[73] Assignee: Thomson-CSF, Paris, France

[21] Appl. No.: 78,808

[22] Filed: Sep. 25, 1979

[30] Foreign Application Priority Data

Sep. 29, 1978 [FR] France ..... 78 27923

[51] Int. Cl.³ ..... F02D 5/16

[52] U.S. Cl. ..... 123/414; 123/415; 123/416; 123/643

[58] Field of Search ..... 123/414, 415, 416, 417, 123/418, 428, 643

[56] References Cited

U.S. PATENT DOCUMENTS

| | | | |
|---|---|---|---|
| 3,830,207 | 8/1974 | Joseph | 123/416 |
| 3,838,671 | 10/1974 | Farr | 123/602 |
| 3,906,920 | 9/1975 | Hemphill | 123/595 |
| 4,034,731 | 7/1977 | Sato | 123/599 |
| 4,112,895 | 9/1978 | Habert | 123/414 X |
| 4,250,846 | 2/1981 | Menard | 123/414 |

*Primary Examiner*—Tony M. Argenbright

*Attorney, Agent, or Firm*—Roland Plottel

[57] ABSTRACT

An internal combustion engine with M cylinders having an electronic ignition system, a pistons position sensor having a set of M+1 identical conductive members, which are synchronous with rotation of the engine's crankshaft. M of the conductive members are regularly spaced. Two fixed detectors adjacent the rotating members sense the members and supply identical electrical signals. The detectors are spaced to provide the signals out of phase by an amount that is substantially higher than the maximum ignition advance of the engine. Electronic circuits process the signals from the two detectors, include a first circuit that supplies a synchronization signal for the cycle igniting the engine, and a second circuit, which supplies two representative synchronization signals of the static advance and of the maximum dynamic advance during ignition.

4 Claims, 11 Drawing Figures

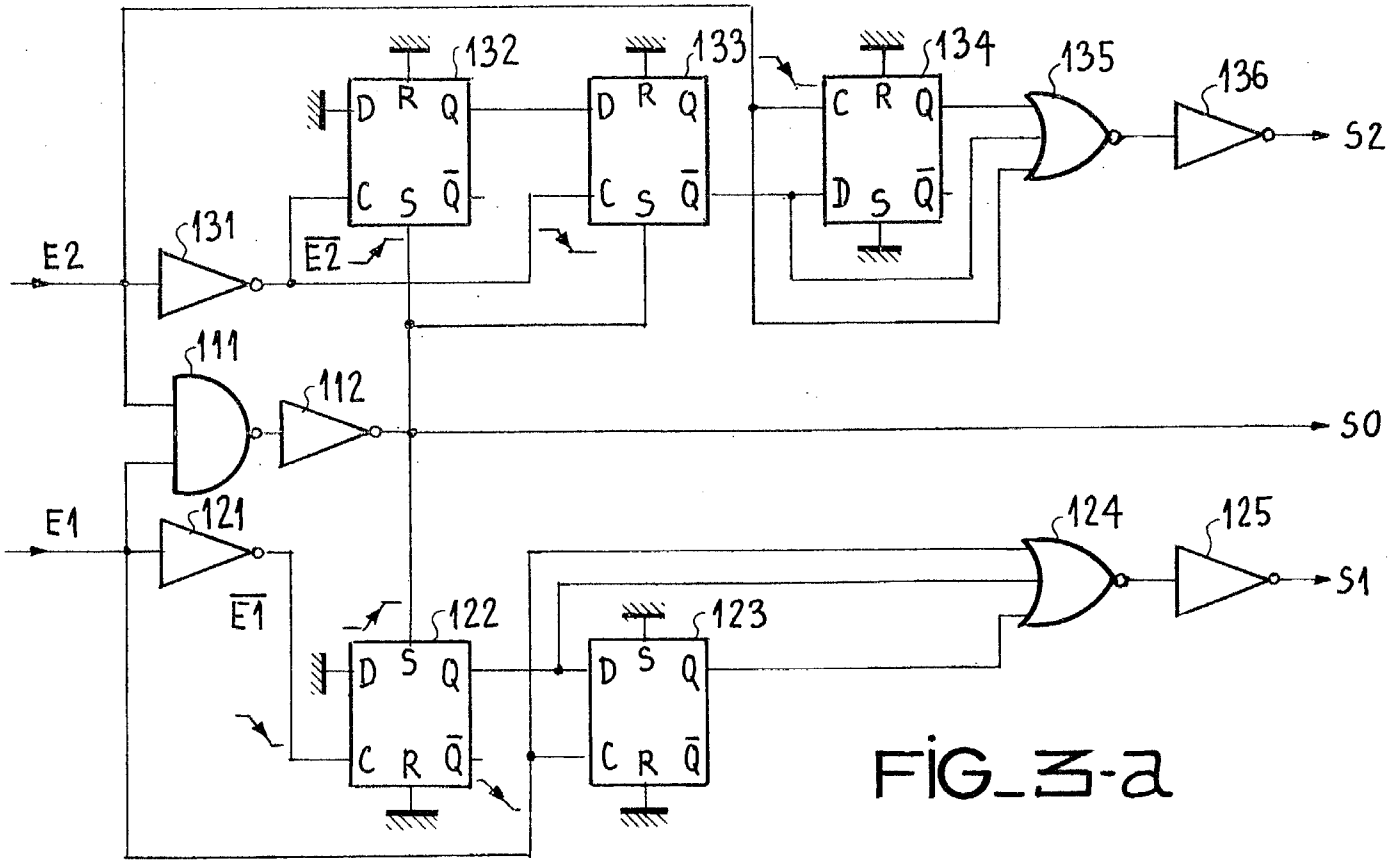
FIG_3-a

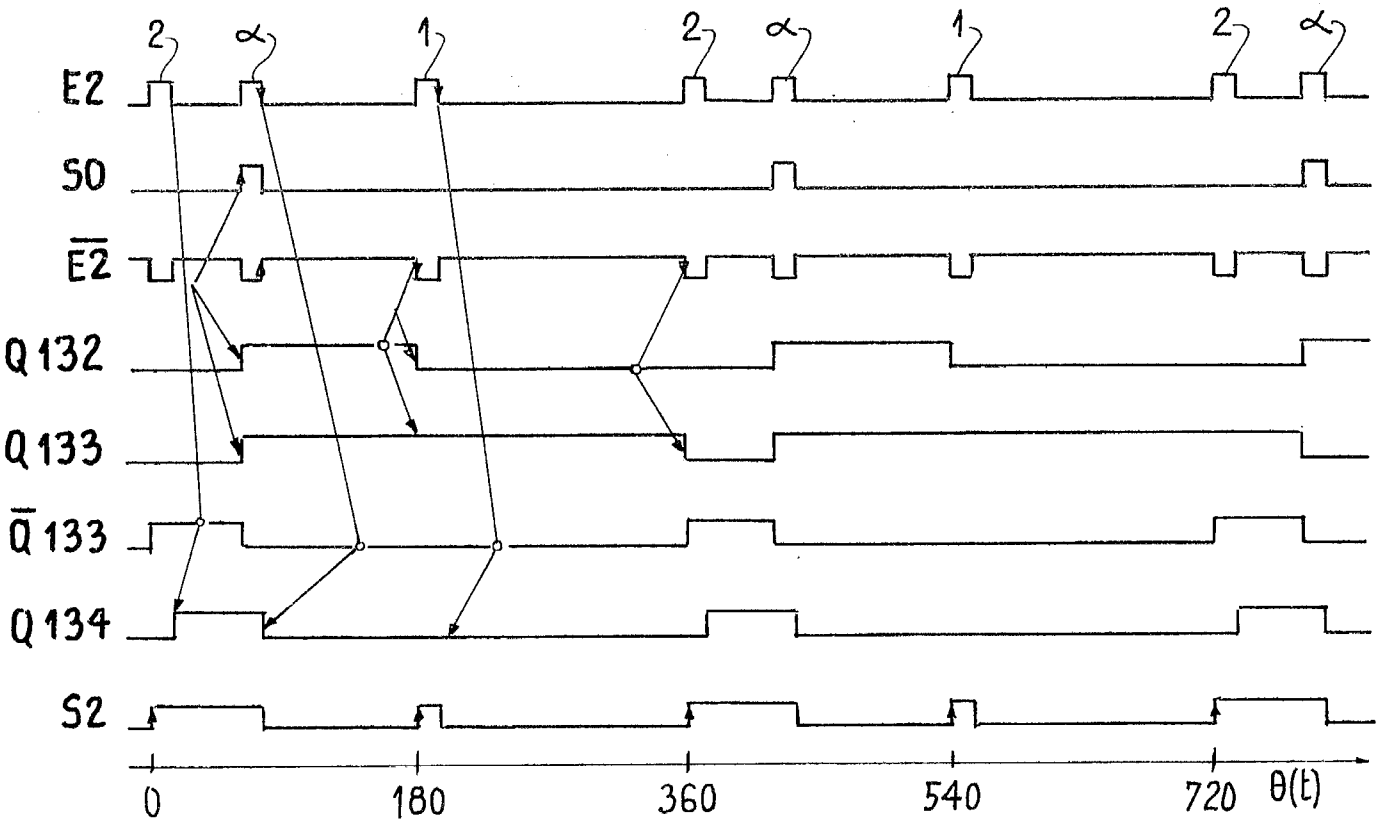
FIG. 3-C

SHAFT POSITION SENSOR FOR INTERNAL COMBUSTION ENGINE EQUIPPED WITH AN ELECTRONIC IGNITION SYSTEM

TECHNICAL FIELD

The invention relates generally to the ignition system of a multicylinder, internal combustion engine. More specifically, in a preferred embodiment, this invention relates to an electronic ignition system having a shaft position sensor which provides a plurality of electrical signals to permit synchronization of the ignition system with the engine.

DISCUSSION OF THE PRIOR ART

An electronic ignition system for a multicylinder internal combustion engine requires an automatic advance circuit which, at a given instant of time determined by the engine's operation, provides electrical signals which make it possible, by means of a timing circuit, to fire spark generators sequentially, the outputs of the spark generators being connected to the spark plugs which are mounted in the engine's cylinders.

In an electronic ignition system, in order to ensure perfect operation of the automatic advance circuit under all operating speeds, automatic advance circuits have heretofore been employed. These automatic advance circuits are typically made up of two channels whose operation is mutually exclusive; a first channel that operates during the starting and slowing speeds of the engine; and, a second channel that operates at cruising speed. In order to reduce by a factor of two the number of spark generators required, paired secondary spark generators have also been priorly employed.

In order to ensure the synchronization of an ignition system having an automatic advance circuit with double channel ignition and a timing circuit linked to a number of spark generators, it is necessary to have a sensor, or shaft position sensor, which provides three electrical signals synchronized to the engine's rotation. These signals are:

(1) a first signal indicating the instant when the pistons pass a point near Top Dead Center (TDC);

(2) a second signal identical to the first, the relative phase shift between the first and second signals being at least equal to the maximum lead angle to be controlled;

(3) a third signal to permit sequential discharge, in cycle, of the secondary spark generators, whether paired or not.

In addition, it would be desirable to be able to provide, on the basis of one, or a combination, of these signals, a continuous signal which is proportional to the rotation speed N of the engine, and, possibly, additionally two-state signals which are indicative of the engine's rotational speed, for example, the starting, slowing, cruising and overdrive speeds, or an assigned speed.

U.S. Application Ser. No. 860,492, filed Dec. 14, 1977, now U.S. Pat. No. 4,250,846, corresponding to French patent application No. 76.38128, filed on Dec. 17, 1976, discloses the use of a piston position sensor linked to an engine exit shaft; this sensor delivers three electric signals, with the characteristics listed above. In this prior art sensor, metallic members are arranged on a disc rotated by the engine and a pair of angularly displaced detectors detect the passage of the members and provide two electric signals which are combined in a coincidence circuit to provide a reference signal for the engine's ignition cycle. In this type of sensor, there are two sets of members: a first set made up of short metallic segments and a second set made up of longer metallic segments the arc of which is at least equal to the maximum lead angle to be controlled.

A drawback to of this type of sensor is that when the diameter of the disc to which the members are attached is large, and when the lead angle to be controlled is large and the length of the segments of the second set of members correspondingly long, this second set of members is subject to excessive mechanical strains at high rotation speeds.

SUMMARY OF THE INVENTION

The purpose of the instant invention is to remedy the above defects by providing a piston position sensor in which all of the metallic members are identical and of small dimension.

One advantage of such a sensor is that the lightness of the members enables them to be placed on a disc having a larger diameter.

A second advantage is that the identical nature of the members simplifies the problems of large-scale production.

The present invention also contemplates a sensor whose electromechanical components can easily be integrated with the engine in that the members can be fixed by simple means to the flywheel of the engine or to the clutch disc, for example, and the detectors can be mounted in the protective casing of the flywheel or the clutch.

For the purpose of providing synchronization signals for an electronic ignition system including a double-channel automatic advance circuit and a number of spark generators, the sensor provided for in the invention comprises:

(1) electromechanical sensing means comprising first of a set of members all of them substantially identical, arranged on an element turning synchronously with the engine's rotation and, second, of a pair of fixed detectors, placed in a protective casing for the turning element; the set of members including regularly spaced main members, in a number proportional to the number of the engine's cylinders, and at least one auxiliary member displaced at an angle $\phi_D$ at least equal to the lead angle $\phi_A$ to be controlled; the pair of detectors being positioned with regard to the length of stroke of the members and the relative angular interval in the two detectors being equal to the angle $\phi_D$; and (2) an electronic means for processing the output signals of the detectors; these means being made up of three circuits: a coincidence circuit which combines the output signals of the two detectors and supplies an output signal S0 corresponding to the ignition cycle; a first logic circuit which receives the output signal of detector D1 and the output signal S0 of the coincidence circuit, and supplies an output signal S1 corresponding to the moments of passage of the pistons near the TDC and a second logic circuit which receives the output signal of detector D2 and the output signal S0 of the coincidence circuit and supplies an output signal S2 corresponding to the moments of passage of the pistons at a point anterior to the TDC.

Other characteristics and advantages of the invention will appear from the detailed description which follows. This description will refer to the annexed drawings, which represent an illustrative embodiment of the invention. These drawings are provided for explanatory purposes but are in no way limiting.

BRIEF DESCRIPTION OF THE DRAWING

FIG. 3*a* represents, in the form of a schematic diagram, an illustrative electronic system for use with a shaft position sensor according to the invention;

FIG. 3*c* represents the timing diagrams for the electronic signals generated by a second logic circuit in said electronic system;

DETAILED DESCRIPTION OF THE INVENTION

In the following description, it will be assumed that the basic operation of a multicylinder internal combustion engine is well known. Such information is widely available in standard technical works.

Figure 1A:
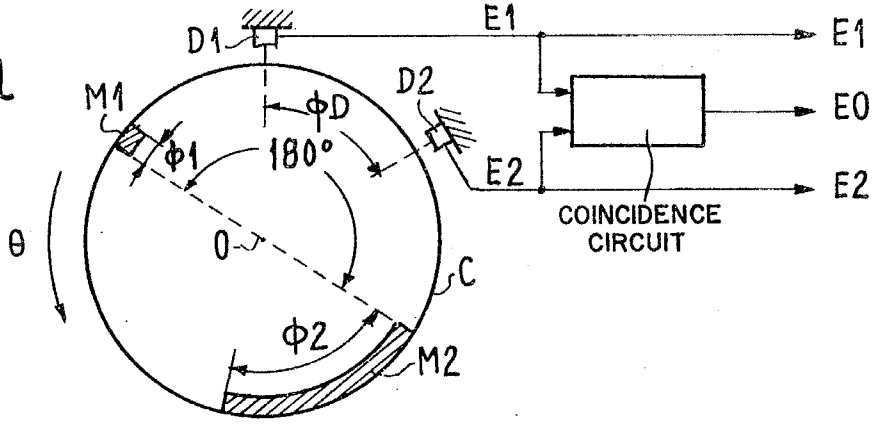
FIG. 1*a* represents, in the form of a functional diagram, a prior art shaft position sensor.

FIG. 1*a* represents, in simplified schematic form, a prior art sensor intended for an engine having two groups of two cylinders, with two paired secondary spark generators. This sensor comprises essentially:

(1) a disc C rotated around a central axis 0 by the crankshaft of the engine. Two metal members are set on the edge of the disc, a member M1 having an arc $\phi_1$ and a member M2 having an arc $\phi_2$; the angular spacing between members M1 and M2 being equal to 180°;

(2) a pair of fixed detectors D1 and D2 arranged in relation to the length of stroke of members M1 and M2, the relative angular spacing between the two detectors being equal to an arc $\phi_D$. Detector D1 supplies an output signal E1 and detector D2 provides an output signal E2.

(3) an electronic coincidence circuit having two inputs; one connected to the output of detector D1 and the other connected to the output of detector D2. The electronic circuit supplies an output signal E0.

By construction, the relative angular spacing $\phi_D$ of the two detectors has a value greater than the maximal lead angle $\phi_D$ to be controlled, the value of arc $\phi_1$ being smaller than the value $\phi_D$ and the value of arc $\phi_2$ is greater than the value $\phi_D$; the direction of rotation of disc C is indicated by the arrow; and means (not shown) are provided to maintain the relative angular phase between disc C and detectors D1 and D2.

Figure 1B:
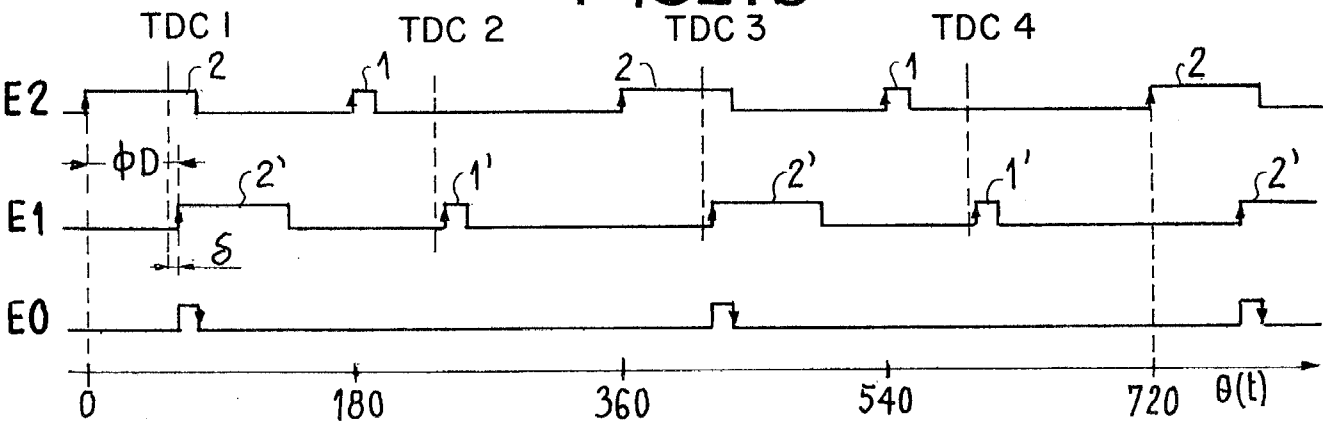
FIG. 1*b* represents the timing diagrams of the output signals generated by the sensor in FIG. 1*a;*

FIG. 1*b* represents the timing diagrams of the output signals from the sensor shown in FIG. 1*a*. It may be recalled that an ignition cycle of the engine corresponds to two revolutions of the crankshaft; consequently, a complete ignition cycle corresponds to a 720° rotation of disc C.

In FIG. 1*b*, the signal E2, considered during an ignition cycle, comprises two pulses 2, corresponding to the passage of member M2 past detector D2 and two pulses 1 corresponding to the passage of member M1 past detector D2.

Signal E1 comprises a sequence of pulses 1', 2' identical to pulses 1, 2, this sequence being retarded by a phase lag of angle $\phi_D$. Signal E0 results from the logical conjunction of signals E1 and E2. The leading edges of signals E1 and E2 define the instants of synchronization of the automatic advance circuit and the trailing edges of signal E0 can be used to synchronize a timing circuit of signals triggering the spark generators.

The TDC reference points situated near the leading edges of signal E1 are indicated by dotted lines in FIG. 1*b*, the lag between the TDC and the leading edges of signal E1 being equal to a static phase angle d.

Figure 2A:
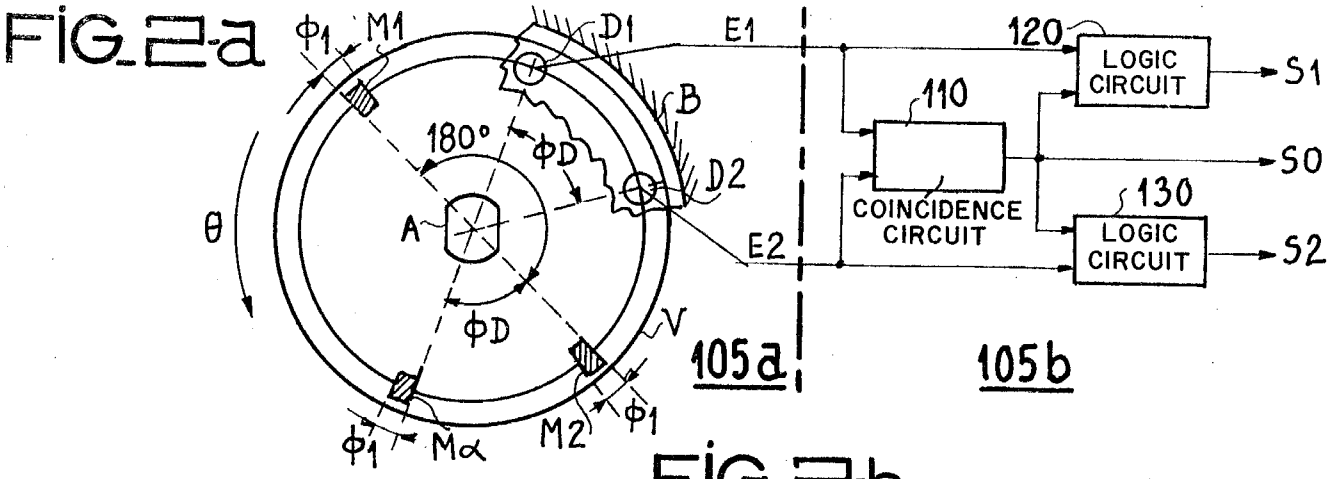
FIG. 2*a* represents, in the form of a functional diagram, an illustrative shaft position sensor according to the invention.

FIG. 2*a* represents, in functional diagram form, an illustrative sensor, in accordance with the invention. As before, this sensor is intended for use in an engine having two groups of two cylinders, each group being fed by a paired secondary spark generator. This sensor as provided comprises:

(1) electromechanical means 105*a* comprising three identical members including two main members: a member M1 and a member M2 diametrically opposed, and an auxiliary member M$\alpha$ identical to member M1 and M2, member M$\alpha$ being angularly displaced with respect to members M2 by an arc $\phi_D$; a pair of fixed detectors D1 and D2 whose relative spacing is equal to the angle $\phi_D$, already defined; and (2) electronic means 105*b* comprising three circuits: a coincidence circuit 110 having two inputs, one input being connected to the output of detector D1 and the other input connected to detector D2; a first logic circuit 120, also having two inputs, one being connected to the output of detector D1 and the other input being connected to the output of the first logic circuit 110; and a second logic circuit 130, also having two inputs, one input being connected to the output of detector D2 and the other input being connected to the output of the first logic circuit 110.

In FIG. 2*a*, the three members M1, M2 and M$\alpha$ are fixed on a turning element V directly driven by shaft A of the engine's crankshaft. For example, the turning element may comprise the engine's flywheel. The detectors D1 and D2 are placed in a housing B, which may comprise the protective casing of the flywheel, partially represented in FIG. 2*a*. The output signals from detectors D1 and D2 are respectively signals E1 and E2, and the output signals from circuits 110, 120 and 130 are respectively signals S0, S1 and S2.

Figure 2B:
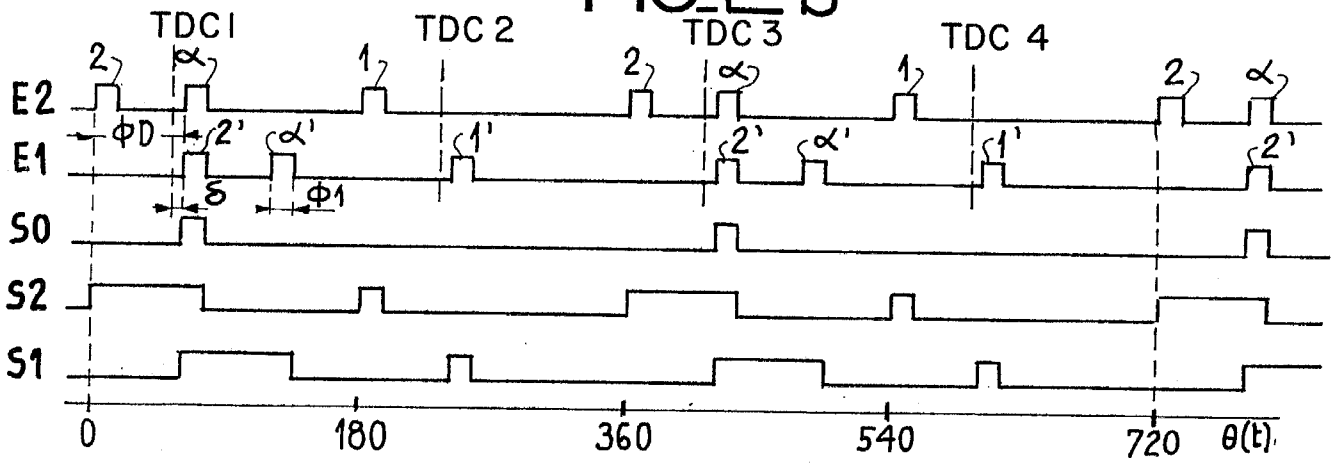
FIG. 2*b* represents the timing diagrams of the output signals generated a shaft position sensor according to the invention.
Figure 3B:
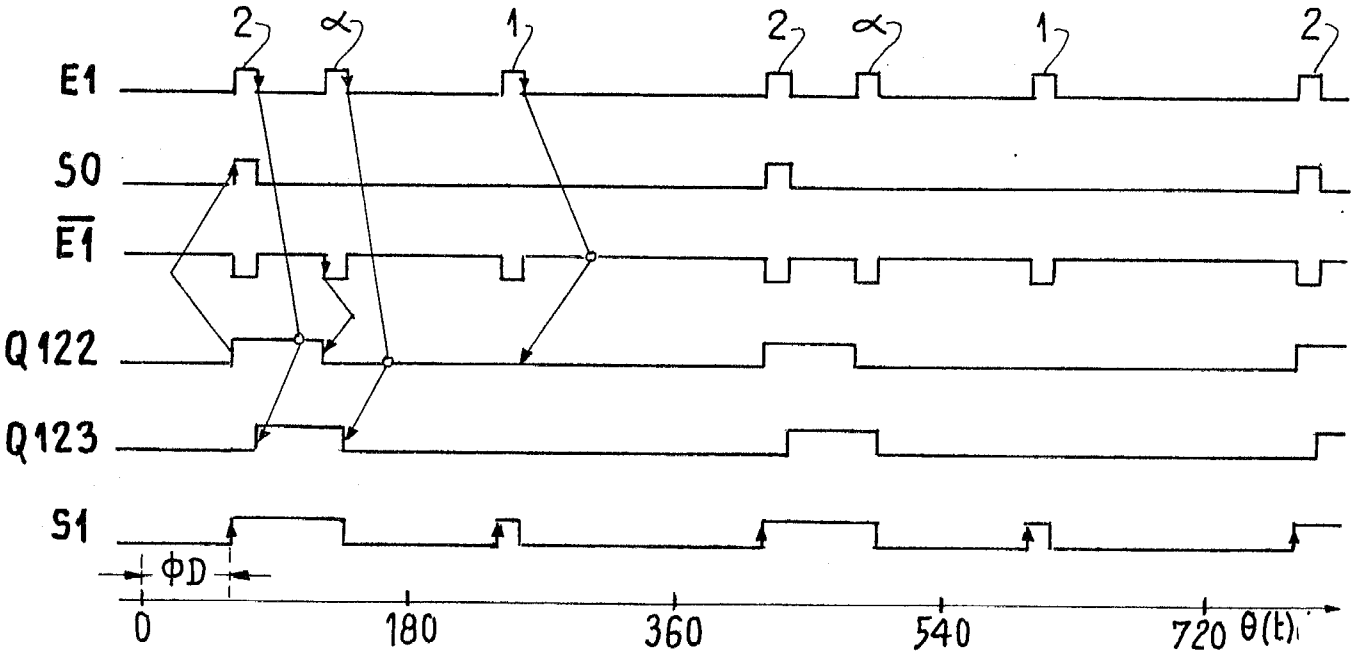
FIG. 3*b* represents the timing diagrams for the electronic signals generated by a first logic circuit in said electronic system.

FIG. 2*b* represents the timing diagrams of the signals generated by the sensor in FIG. 2*a* during one ignition cycle of the engine. Signal E2 is formed by the sequence of pulses 2, $\alpha$ and 1 resulting from the passage of members M2, M$\alpha$ and M1 past detector D2. Signal E1 is formed by the sequence of signals 2', $\alpha'$ and 1' resulting from the passage of the respective members M2, M$\alpha$ and M1 past detector D1. Signal S0 is the result of the logical conjunction of signals E1 and E2, while signal S2, generated by circuit 120, is the result of the logical combination of signals E1 and S0. The leading edges of signals S1 and S2 permit synchronization of the automatic advance circuits and the trailing edges of signal S0 permit synchronization of the timing circuit of the signals triggering the spark generators.

The frequency of the signals generated by the sensor is proportional to the speed of rotation N of the engine, thus these signals may be used to generate a signal representative of the speed of rotation N. The relative phase of signals E1 and E2 may also be used to determine the different rotation speeds of the engine. In this figure, the static phase-angle $\delta$ of the ignition is indicated with a negative value; it must be understood, however, that the value of this angle may be zero, positive or negative.

By construction, according to the kind of engine under consideration, the members and detectors may be placed so as to agree with the timing of the ignition, thus a sensor of this kind will not necessarily require an auxiliary timing system. In FIG. *2a*, the members have been represented as arc segments, however the members can be designed in other ways, for example cylindrically, with or without flats. The members may be affixed by means of a threaded element screwed into the width of the flywheel's ground. The metal members may be constructed of the same metal as the turning element on which the members are placed. Arc $\phi_1$ may be several degrees in size, and angle $\phi_D$ twenty or more degrees, with an extreme value of 90° in the model described. In practice, the diameter of element V is in the 150 to 300 mm. range.

FIG. *3a* represents, in block schematic form, one illustrative embodiment of logic circuits 110, 102 and 130, shown in FIG. *2a*. FIGS. *3b* and *3c* represent timing diagrams of the main input/output signals generated by the component parts of FIG. *3a*.

In FIG. *3a*, coincidence logic circuit 110 is made up of a NAND gate 111 having two inputs, one input receiving the output signal E1 of detector D1 and the other input receiving the output signal E2 of detector D2. The output of gate 111 is complemented by an inverter 112 whose output signal is signal 50.

Logic circuit 120 includes the following components: an inverter 121, two bistable circuits 122 and 123, a NOR gate 124 type and an inverter 125. The operation of this circuit 120 will now be described with reference to FIG. *3b*. The leading edge of signal S0, applied at input S of bistable circuit 122, positions output $Q_{122}$ in high position; the trailing edge of signal E1$\alpha$, complemented by inverter 121, is applied at input C of bistable circuit 122 and samples the position of input D, which is referenced to the low position. Bistable circuit 123, through its input C, samples input D, which is connected to output $Q_{122}$; by the action of the trailing edges of signal E1, pulses E1.2 thus position output $Q_{123}$ in high position and pulse E1.$\alpha$ positions this output $Q_{123}$ in low position. The logical conjunction at the three-input NOR gate 124, complemented by inverter 125, of the three signals E1, $Q_{123}$ and $Q_{124}$ supplies the output signals S1; the leading edges of the pulses of signal S1 provide the effective signals of synchronization of the automatic advance circuits.

Logic circuit 130 includes the following components: an inverter 131, three bistable circuits 132, 133 and 134, and a NOR gate 135 complemented by an inverter 136. The operation of logic circuit 130 will now be described with reference to FIG. *3c*. The leading edge of the pulses constituting signal S0 applied at input S of bistable 132 positions output $Q_{132}$ in high position, the trailing edges of signal $\overline{E2}$ (E2 complemented by inverter 131) applied at input C of the bistable sample the position of input D, which is referenced to the low position. The leading edge of the pulses of signal S0, which is also applied at input S of bistable 133 positions output $Q_{133}$ of the latter in high position; the trailing edges of signal $\overline{E2}$ (signal E2 complemented by inverter 131) applied at input C sample the position of input D which is connected to output $Q_{132}$, thus permitting the repositioning of bistable 133 in low position. Input D of bistable 134 is sampled at its input C by the trailing edges of the square pulses constituting signal E2, input D of bistable 134 being connected to output $\overline{Q}$ of bistable 133; consequently, output Q of bistable 134 is moved to high position by square pulses E2.2 and to low position by square pulses E2.$\alpha$ and E2.1. The logical conjunction at three-input NOR gate 135, whose output is complemented by inverter 136, of the three signals E2, $\overline{Q}_{133}$ and $Q_{135}$ supplies signal S2, the leading edges of signal S2 supplying the effective synchronization signals of the automatic advance circuits.

The logic circuits which have just been described may also easily be put together from integrated logic components, such as NAND or OR gates and D bistables, available commercially in standard packaging.

Figure 4:
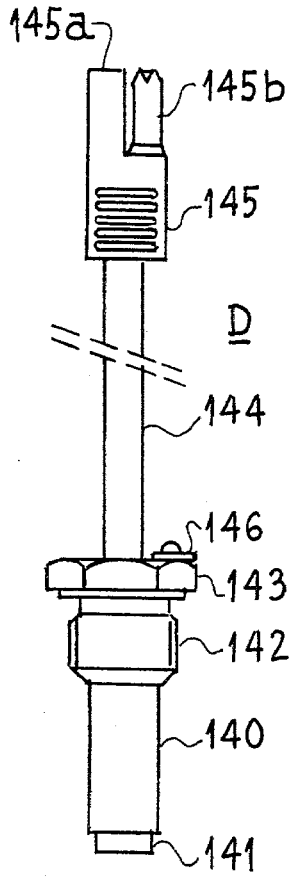
FIG. 4 represents, in side view, an illustrative detector.

FIG. 4 represents an illustrative configuration of detectors D1 and D2 of a sensor according to the invention; these two detectors are identical and are advantageously of the proximity detector type using a high frequency oscillator whose oscillating circuit is quenched by the proximity of a metallic object. A detector D is made up of:

(1) a hollow metallic body 140, within which are placed the electronic circuits, including, in protruding form, oscillating circuit 141. The body 140 is made up of: a means for fixing 142 to the flywheel's casing; this fixing means may comprise, for example, a threaded base and a screwing mechanism 143, such as, for example, a hexagonal nut;

(2) an electric connection including: a bifilar cord 144 terminating in a current intake 145 and having an output signal 145*a* and a power intake 145; and a riveted lug 146 which may be connected, if necessary, to the electric ground of the engine.

The electronic circuits of the proximity detector, which are known per se, will not be described, as they are commercially available in accordance with an integrated technology.

An application of a shaft position sensor to a system of electronic ignition will now be described.

Figure 5:
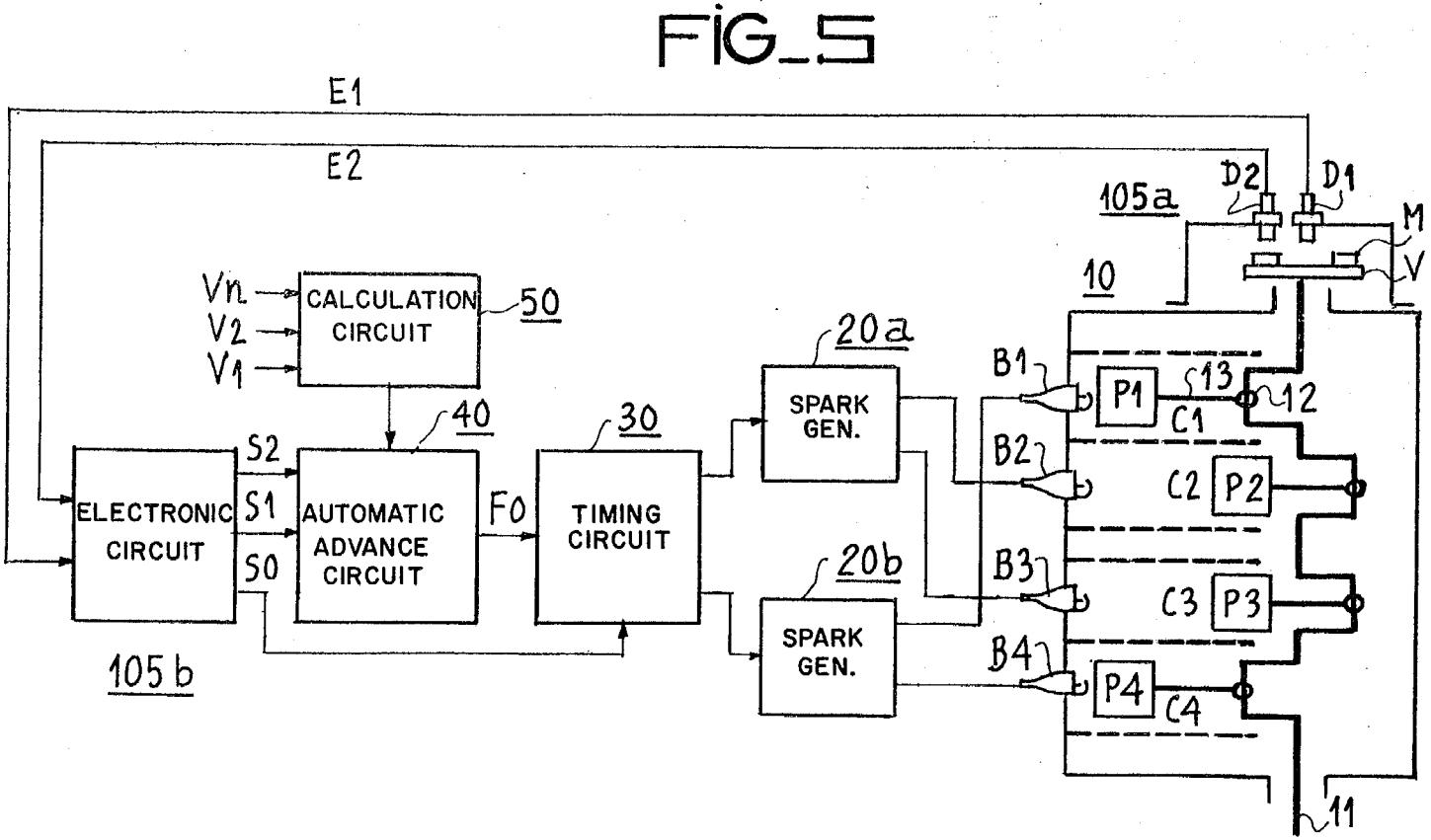
FIG. 5 represents, in the form of a schematic diagram, an example of the application of a sensor according to the invention to a four-cylinder engine equipped with an electronic ignition system.

FIG. 5 represents, in the form of a block schematic diagram, a complete electronic ignition for a four-cylinder combustion engine into which is integrated an electromechanical system 100*a* according to the invention.

Engine 10 contains four cylinders C1 to C4 shown in dotted lines. Four spark plugs B1 to B4 are placed in these cylinders; the crankshaft 11 has four crankpins 12 which move four connecting rods 13 connected to the four pistons P1 to P4, pistons P1 and P4 comprising a first group of pistons and pistons P2 and P3 comprising a second group of pistons. It will be assumed that the ignition cycle of the engine corresponds to the sequence 1, 3, 4, 2.

Crankshaft 11 moves a flywheel V on which is arranged a set of members, for example, the three members, shown in FIG. 2*a*.

Detectors D1 and D2, already described and shown in FIG. 4, are set on the protective casing of the flywheel; the output signals of these detectors are applied to the inputs of the electronic system 105*b* of the sensor. This electronic system supplies synchronization signals S0, S1 and S2, as already described. Two paired secondary spark generators 20*a* and 20*b* feed the plugs, the two outputs of generator 20*a* being connected to plugs B1 and B4 of the first group of pistons and the two outputs of generator 20*b* being connected to plugs B2 and B3 of the second group of pistons.

Timing circuit 30 ensures the sequential firing, in cycle, of spark generators 20*a* and 20*b*. The timing circuit has two inputs, one input to receive the firing impulses F0 supplied by automatic advance circuit 40 to the ignition. The timing circuit also has two outputs, corresponding to the two possible states, the first output supplying firing impulses F1 to generator 20*a* and a second output supplying firing impulses F2 to generator 20*b*. The automatic advance circuit 40 makes it possible, below a given rotation speed N0 of the engine, to transfer directly the leading edges of the pulses comprising input signal S1 to output F0, and, above rotation speed N0, to transfer to output F0, with a lag which is a function of the engine's running speed, the leading edges of the pulses which comprises input signal S2. The duration of the delay introduced by circuit 30 is controlled by an advance order signal $V_\phi$ computed by a calculation circuit 50. This calculation circuit may be of a known type and permits the conversion of the input measuring signals V1, V2 . . . Vn, representing the engine's running speed into a lead/lag signal $V_\phi$.

The configuration of the metallic members of a shaft position sensor according to the invention must, of course, be adapted to conform to the number of two-cylinder groups included in the engine.

Figure 6:
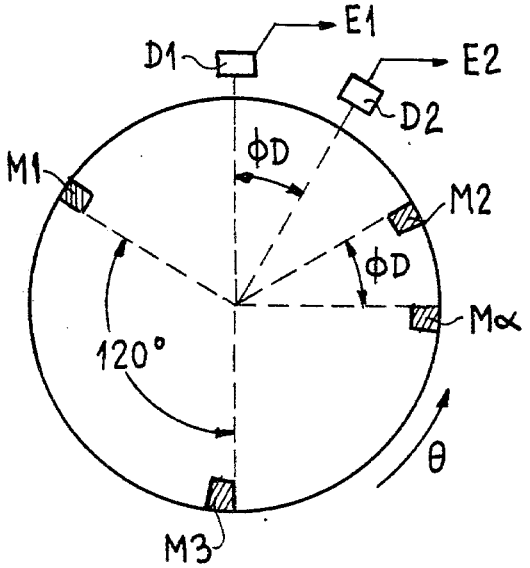
FIG. 6 represents, in schematic form, the configuration of the electromechanical system of a sensor intended for an engine utilizing three groups of two cylinders.

For illustrative purposes, FIG. 6 represents, in schematic form, the electromechanical means 105*a* of a shaft position sensor, according to the invention, which is intended for a six cylinder engine comprising three groups of two cylinders. This sensor makes it possible to synchronize an electronic ignition system comprising double-channel automatic advance circuits, a three-state timing circuit and three paired secondary spark generators. The set of members M, all identical, includes the main members M1, M2 and M3 whose relative angular spacing is equal to 120°. As shown, the auxiliary members M$\alpha$ is angularly displaced by an angle $\phi_d$ equal to the angle of relative spacing of the two detectors D1 and D2, the size of this angle $\phi_D$ having a value at least equal to the greatest angle of advance to be controlled. The electronic system of the sensor is not shown in FIG. 6 as it is identical to that shown in FIG. 2*a*.

It will be recalled that when the members are rotated by direct action of the engine's crankshaft it is always necessary to utilize a paired secondary spark generator. The configuration for an electromechanical system adapted to an eight-cylinder engine is directly deducible from what has been described above.

The configuration for the electromechanical means for a shaft position sensor according to the invention must be modified when the members are rotated by the engine's timing shaft, because of speed of revolution of the timing shaft is equal to the half value of that of the crankshaft.

Figure 7:
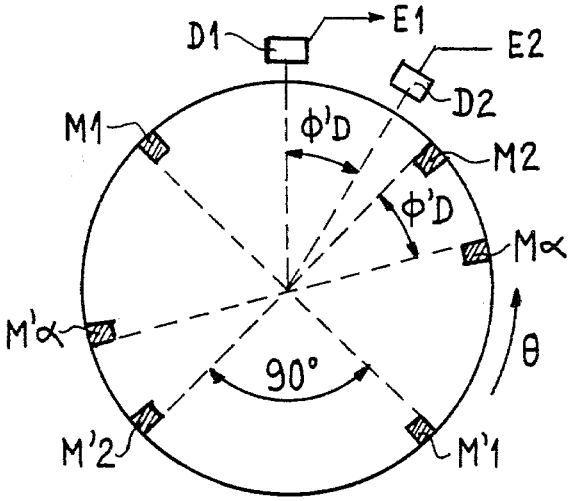
FIG. 7 represents, in schematic form, the configuration of the mechanical system for a sensor whose members are rotated by the engine's timing shaft.

For illustrative purposes, FIG. 7 represents in schematic form the configuration of the electromagnetic means 105*a* of a shaft position sensor intended for a four-cylinder engine equipped with an ignition system including two paired secondary spark generators. The set of members is made up of a first pair of main members M1 and M'1, diametrically opposed, and a secondary pair of identical main members, orthogonal to the first pair. The auxiliary members M$\alpha$ and M'$\alpha$, identical to the main members, are angularly displaced by an angle $\phi'_D$ whose value is equal to half of angle $\phi_D$ shown in FIG. 2*a*. Similarly, the relative angular spacing of the two detectors D1 and D2 is also equal to the value $\phi'_D$. The electronic system 105*b* of the sensor as described above in FIG. 2*b* remains the same. When the engine is equipped with four simple secondary spark generators (one of the secondary outputs being connected to ground), one of the members M$\alpha$ or M'$\alpha$ must be eliminated and a timing circuit for the firing signals for the spark generators which can handle four states must be utilized. The configuration of the electromechanical system for a multicylinder engine is directly deducible from what has been described above.

The advantages provided by a shaft position sensor of the kind described in its applications to multicylinder internal combustion engines can now be seen more clearly. The elements of the sensor's electromechanical system are sturdy, and therefore perfectly adapted to the requirements of the internal combustion engine industry. Further, the configuration of the electromechanical system can be adapted to different types of multicylinder engines. Lastly, the electric signals supplied by the sensor are compatible with the various systems of electric ignition in existence.

The invention is not limited in its applications to the synchronization of the circuits of an electronic ignition system; for example, the sensor's output signals can be used to provide information on the engine's speed of rotation on an automobile's dash board, or these signals can be supplied to one or several angular speed discriminators so as to indicate the engine's various speeds of rotation.

The invention has applications in the traction engine and fixed engine industries.

We claim:

1. Internal combustion engine fitted with M cylinders having an electronic ignition system including a position sensor for pistons comprising a set of M+1 conductive members, all identical, synchronously rotated by the engine's crankshaft, this set of conductive members comprising M members equally spaced from each other, and the +1 member being angularly displaced from one of said M members, two fixed adjacent detectors that supply identical electrical signals out of phase by an angle that is substantially larger than the maximum ignition advance angle of the motor, electronic means for processing the output signal of these two detectors: including first means for supplying a synchronisation signal for the cycle igniting the motor, a second means for supplying two representative synchronisation signals of the static advance and of the maximum dynamic advance during ignition.

2. Internal combustion engine according to claim 1, in which the set of conductive members is arranged on the periphery of the engine's inertia flywheel.

3. Internal combustion engine, according to claim 10, in which the two adjacent detectors are fixed on the housing of the flywheel.

4. Internal combustion engine, according to claim 11, in which the two adjacent detectors are of a type that included an autooscillator damped by the presence of a conductive body.

* * * * *